United States Patent [19]

Tarrants

[11] 3,968,761

[45] July 13, 1976

[54] HAND AND SEWING MACHINE NEEDLE THREADER

[76] Inventor: Paul Tarrants, 207 Orchard Lane, Henderson, Ky. 42420

[22] Filed: May 9, 1975

[21] Appl. No.: 576,186

[52] U.S. Cl. ..... 112/225; 223/99

[51] Int. Cl.[2] ..... D05B 53/00; D05B 87/00

[58] Field of Search ..... 223/99; 112/224, 225, 112/226; 29/241

[56] References Cited

UNITED STATES PATENTS

| | | | |
|---|---|---|---|
| 912,915 | 2/1909 | Stockland | 223/99 |
| 2,494,444 | 1/1950 | Lyle | 112/225 |
| 3,502,045 | 3/1970 | Hanyu | 112/225 |

FOREIGN PATENTS OR APPLICATIONS

| | | | |
|---|---|---|---|
| 1,023,282 | 12/1952 | France | 223/99 |
| 257,092 | 3/1949 | Switzerland | 223/99 |
| 8,430 | 9/1909 | United Kingdom | 223/99 |

*Primary Examiner*—George H. Krizmanich
*Attorney, Agent, or Firm*—Maurice L. Miller, Jr.

[57] ABSTRACT

A sewing needle threader using the presser foot of a sewing machine as a housing is disclosed. A movable rod is slidably mounted in the housing and contains a tiny hook adapted for insertion through the eye of a needle on one end of the rod. A spring is coiled around the rod and confined between defining walls of a chamber of the housing into which the other end of the rod projects. The rod is adapted to attach to a pivotally mounted handle located outside of housing. The handle may be placed in a raised position when not in use and may be lowered into alignment with the rod for advancing the hook through the front of the housing into engagement with the eye of a needle. In another embodiment the housing is adapted for use in threading hand held needles.

7 Claims, 5 Drawing Figures

HAND AND SEWING MACHINE NEEDLE THREADER

BACKGROUND OF THE INVENTION

This invention relates to improvements in needle threading devices and is adaptable to use in connection with the threading of both hand held and sewing machine needles.

The threading of both hand held and sewing machine needles is traditionally a difficult task often requiring great patience, a steady hand and good eye sight. Of the large number of needle threaders known in the prior art, most are either bulky and require a great deal of space or are of relatively complicated construction. Other prior art needle threaders are not entirely reliable to accomplish the purpose intended.

As regards prior art needle threaders used on sewing machines, almost all require additional fixtures or assemblies connected to the lower end of the presser bar near the presser foot. U.S. Pat. No. 3,502,045 issued to S. Hanyu on Mar. 24, 1970, discloses an example of such an additional assembly. Also, the needle threader assembly of Hanyu is relatively complicated in that it has a relatively large number of parts.

By means of my invention, these and other difficulties known to the prior art are substantially overcome. Moreover, the principal of my invention is applicable to both sewing machine assemblies and to the threading of hand held sewing needles of varying sizes and dimensions.

SUMMARY OF THE INVENTION

It is an object of the subject invention to provide a needle threader of simple physical construction having a minimum number of moving parts for enhanced reliability.

It is a further object of the subject invention to provide a needle threader adaptable to use in connection with both sewing machines and hand held sewing needles.

It is still another object of the subject invention to provide a needle threader which is small for convenient permanent installation in a sewing machine presser foot.

It is yet another object of the subject invention to provide a sewing machine needle threader as an integral part of the presser foot whereby no additional attachments to the presser bar are required.

Briefly, in accordance with the instant invention a sewing needle is provided having a housing and a movable rod slidably mounted in the housing. A threading means is connected to one end of the rod and is adapted to insert through the eye of a needle. Biasing means is confined in the housing about the rod tending to maintain the threading means in a retracted position in the housing. A means for advancing the rod forward from its' retracted position to an advanced position is provided for moving the threading means out of the housing to a position of engagement with the eye of the needle.

Further objects and advantages of the instant invention will become apparent to those skilled in the art from the following description and attached drawings upon which, by way of example, only the preferred embodiments of the instant invention are illustrated.

DESCRIPTION OF THE PREFERRED EMBODIMENTS

Figure 1:
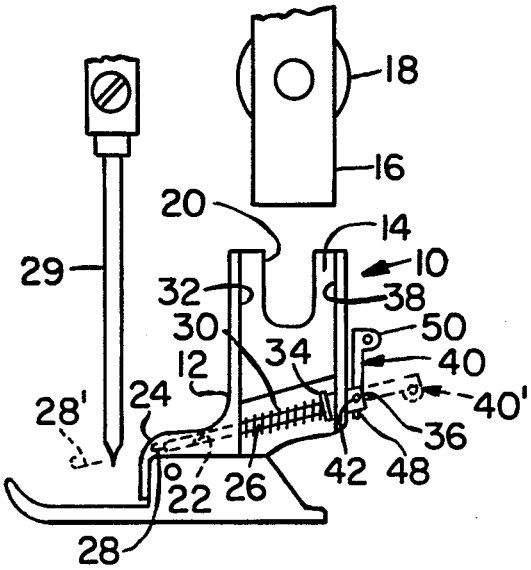
FIG. 1 shows a side elevation view of a sewing machine needle threader, illustrating one preferred embodiment of the instant invention.
Figure 2:
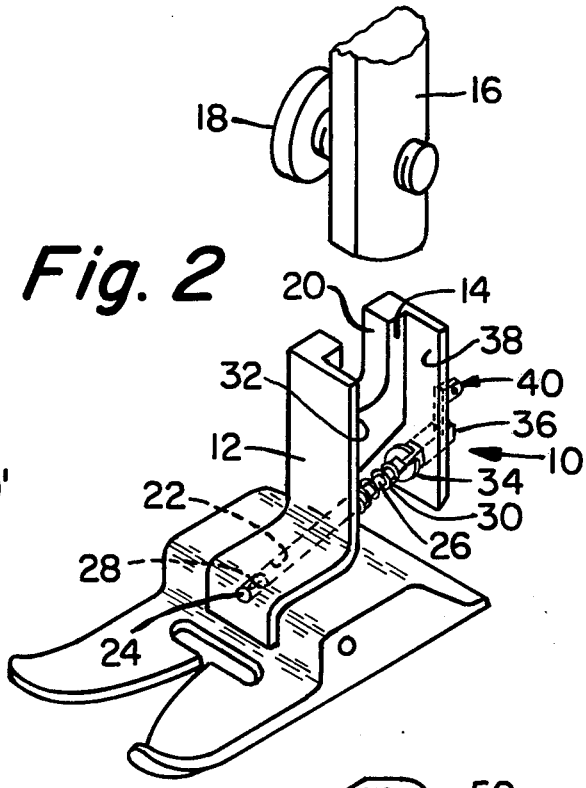
FIG. 2 shows a perspective view of the sewing machine needle threader of FIG. 1.
Figure 3:
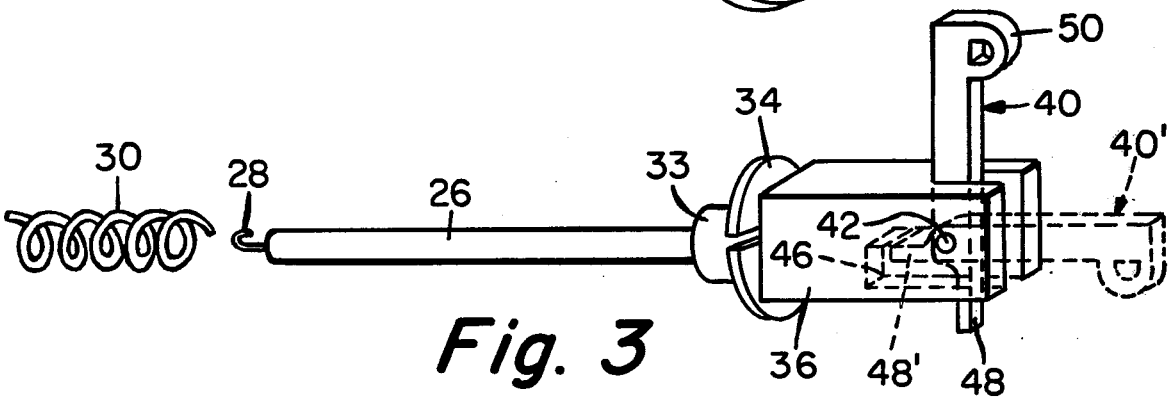
FIG. 3 shows a perspective view of a portion of the needle threader of FIGS. 1 and 2.

Referring now to FIGS. 1–3 there is shown in one preferred embodiment of the instant invention, a sewing machine needle threader 10 using a conventional sewing machine presser foot 12 as a housing. The presser foot 12 includes a channel 14 adapted to receive the bottom end portion of a conventional sewing machine presser bar 16 in the usual and well-known manner. The presser bar 16 is provided with a screw 18 adapted for insertion through a slot 20 in the foot 12 which, when tightened, secures the foot 12 to the presser bar 16, also in the usual manner.

A cylindrical channel 22 is formed in the foot 12 as shown in FIGS. 1 and 2, which channel 22 extends to an opening 24 on the front surface of the foot 12. Within the channel 22 there is slidable disposed, a cylindrical rod 26 containing a tiny hook 28 on the front end thereof adapted to insert through the eye of a sewing machine needle 29 when the rod 26 is urged forward in the manner as hereafter explained. The longitudinal axis of the channel 22 is aligned so as to intersect with the vertical longitudinal axis of the needle 29 when the foot 12 is secured to the presser bar 16.

A coiled spring 30 is disposed about the rod 26 and is confined within the channel 14 between its' defining walls 32 and 38. The spring 30 provides bias tending to maintain the rod 26 in a retracted position when the threader 10 is not in use, whereby the hook 28 is recessed within the channel 22.

The rear end of the rod 26 is attached to a cylindrical yoke 33 (see FIG. 3) which has a diameter suitable for fitting a conventional lock washer 34 thereon. Though the yoke 33 is not essential to the invention, it will probably be needed in most cases in order to provide a sufficiently large surface for fitting a conventional size lock washer thereon. The lock washer 34 is, in turn, of sufficiently large diameter to provide confining means to confine the rod 26 at least partially within the channel 22 at all times in opposition to the biasing force of the spring 30.

The other end of the yoke 33 is attached to a block 36 which extends through an opening in the wall 38 and projects rearward of the foot 12. The block 36 may be urged forward with the fingers into the channel 14 in opposition to the spring 30 to extend the hook 28 through the eye of the needle 29 during the threading operation. However, to avoid having the block 36 extend too far to the rear of the foot 12 when the threader is inoperative, thus getting in the way of the sewing machine operator, the block 36 may be shortened considerably and used in connection with a pivotal handle 40. The handle 40 is shown in an inoperative position, raised against the back of the wall 38. In the inoperative position, the handle 40 is conveniently out of the way of the operator. The handle 40 is adapted to pivot about a pin 42 for lowering the same into an operative position as represented in FIGS. 1 and 3 by dashed lines 40'. The handle 40 may have an enlarged end 50 adapted for ease of holding with the fingers.

An end 48 of the handle 40 extends below the bottom of the block 36 and rotates clockwise into a channel 46 in the bottom of the block 36 as the handle 40 is lowered to the operative position 40'. The end 48 engages the top of the channel 46 when the handle 40 is in line with the rod 26, thus acting as a stop. This tends to stabilize the handle 40 and restrains it from accidentally rotating clockwise below the horizontal alignment with the rod 26 when the handle 40 is being urged forward during the threading operation.

In typical operation of a sewing machine using the threader 10 of the present example, the operator simply rotates the sewing machine needle drive wheel with one hand to raise or lower the eye of the needle 29 into alignment with the longitudinal axis of the rod 26. At the same time the operator uses the other hand to urge the handle 40 and block 36 forward thus extending the hook 28 toward insertion through the eye of the needle 29. By hand rotating the needle drive wheel, a very fine height adjustment of the needle 29 can readily be obtained with most modern home style sewing machines. And by urging the hook 28 against the side of the needle 29, the hook 28 will readily insert through the needle eye as the latter is brought into vertical alignment with the former. Moreover, since the rod 26 is always in intersecting alignment with the vertical longitudinal axis of the needle 29, the vertical alignment procedure is quite simply accomplished even by persons not having particularly keen eye sight or steady hands.

Figure 4:
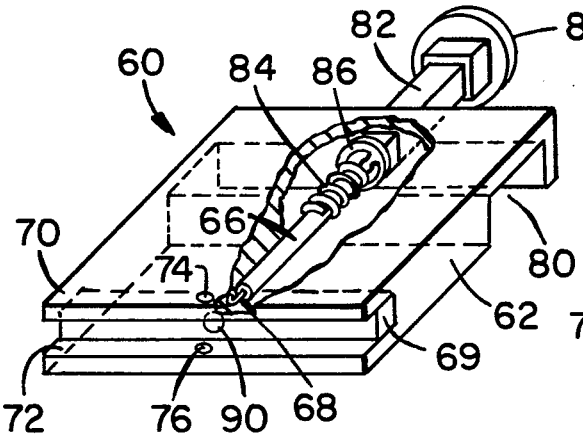
FIG. 4 shows a perspective view of a needle threader adapted for use with hand held sewing needles, illustrating another preferred embodiment of the instant invention.
Figure 5:
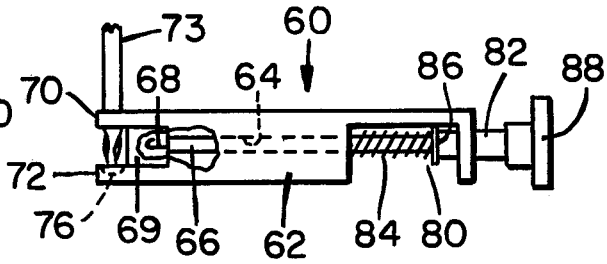
FIG. 5 shows a side elevation view of the needle threader of FIG. 4.

Referring now to FIGS. 4 and 5 there is shown, in another preferred embodiment of the instant invention, a needle threader 60 adapted for use in threading hand held sewing needles. A housing 62 is provided, which may be constructed of metal, plastic or other suitable material. Within the housing 62 there is formed a cylindrical channel 64 in which a cylindrical rod 66 is slidably disposed containing a needle threader hook 68 on the front end thereof. A conventional bar magnet 69 is attached to the front of the housing 62 and is recessed between an upper lip 70 and a lower lip 72. The magnet 69 aids in holding a needle 73 in position during threading thereof.

The channel 64 extends through the magnet 69 to an opening 90. Directly above and forward of the opening 90, a hole 74 is provided in the lip 70 through which the pointed end of the needle 73 is passed. The pointed end of the needle 73 rests in a groove 76 directly below the hole 74 in the lower lip 72. Thus the eye of the needle 73 to be threaded is brought into alignment with the hook 68.

Toward the rear of the housing 62 there is provided a chamber 80 through which a rear portion of the rod 66 passes. The end of the rod 66 is attached to a block 82 and a coiled spring 84 is disposed about the rod 66 and confined between the defining walls of the chamber 80. A lock washer 86 is secured about the end of the rod 66 next to the block 82 to restrain the rod 66 from slipping out of the channel 64 under the influence of the spring 84. If desired, a suitable push button 88 may be attached to the end of the block 82.

Although the instant invention has been described with respect to specific details of certain preferred embodiments thereof, it is not intended that such details limit the scope of the instant invention except insofar as is set forth in the following claims.

I claim:

1. A sewing machine needle threader comprising
a presser foot defining a housing,
a movable rod slidably mounted in said housing,
a threading means connected to one end of said rod and adapted to insert through the eye of a needle,
biasing means confined in said housing about said rod tending to maintain said threading means in a retracted position in said housing, and
means for advancing said rod forward from said retracted position for movement of said threading means out of said housing to a position of engagement with an eye of a needle.

2. The sewing needle threader of claim 1 wherein said advancing means comprises a block connected to the other end of said rod and extending at least partially outside of said housing.

3. The threader of claim 2 further comprising a handle pivotally attached to a portion of said block which is outside of said housing, said handle being adapted for pivotal movement from an inoperative position to an operative position in line with the longitudinal axis of said rod.

4. The threader of claim 1 further comprising means for confining said rod at least partially in said housing.

5. The threader of claim 4 wherein said confining means comprises a lock washer fixedly connected to said rod to limit said retracted position.

6. A needle threader adapted for threading hand held needles comprising
a housing defining a chamber and a channel therein, said channel communicating with said chamber and opening onto a front surface of said housing,
a movable rod slidably disposed in said channel and extending rearwardly into said chamber,
threading means connected to a front end of said rod nearest said front surface and adapted to insert through an eye of a needle,
biasing means confined in said chamber about said rod tending to maintain said threading means in a retracted position in said housing,
means for advancing said rod forward from said retracted position to an advanced position for moving said threading means out of said housing beyond said front surface to a position of engagement with an eye of a needle, and
magnetic holding means attached to said housing for holding an eye of a needle in registry with said opening, said holding means defining a second channel therethrough, disposed in line with said channel defined by said housing.

7. The needle threader of claim 6 further comprising
an upper lip extending from front surface above said holding means, said upper lip defining a hole therein adapted for passing a needle therethrough in front of said channels, and
a lower lip extending from said front surface below said holding means adapted for interfering with the point of a needle passing through said hold.

* * * * *